US008403635B2

(12) United States Patent
Tabata

(10) Patent No.: US 8,403,635 B2
(45) Date of Patent: Mar. 26, 2013

(54) DIFFUSER APPARATUS, CENTRIFUGAL COMPRESSOR, AND TURBO SUPERCHARGER

(75) Inventor: Masakazu Tabata, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 277 days.

(21) Appl. No.: 12/999,831

(22) PCT Filed: Mar. 9, 2010

(86) PCT No.: PCT/JP2010/053900

§ 371 (c)(1),
(2), (4) Date: Dec. 17, 2010

(87) PCT Pub. No.: WO2011/111173

PCT Pub. Date: Sep. 15, 2011

(65) Prior Publication Data

US 2012/0034071 A1 Feb. 9, 2012

(51) Int. Cl.
*F04D 29/46* (2006.01)

(52) U.S. Cl. ..... 415/156; 415/211.2

(58) Field of Classification Search ..... 415/148, 415/156, 211.2, 212.1, 208.1
See application file for complete search history.

(56) References Cited

U.S. PATENT DOCUMENTS

| | | | | |
|---|---|---|---|---|
| 2,392,200 | A * | 1/1946 | Thompson | 415/148 |
| 3,478,955 | A * | 11/1969 | Kunderman | 417/507 |
| 3,992,128 | A * | 11/1976 | Lunsford | 415/161 |
| 4,378,194 | A * | 3/1983 | Bandukwalla | 415/49 |
| 4,844,690 | A * | 7/1989 | DeLaurier et al. | 415/148 |
| 7,658,068 | B2 * | 2/2010 | Mulloy et al. | 60/602 |
| 2008/0138200 | A1 * | 6/2008 | Umeyama et al. | 415/204 |
| 2010/0150701 | A1 * | 6/2010 | Simon et al. | 415/160 |

FOREIGN PATENT DOCUMENTS

| | | | |
|---|---|---|---|
| JP | 2000-130398 | A | 5/2000 |
| JP | 2001-329996 | A | 11/2001 |
| JP | 2008-095678 | A | 4/2008 |
| JP | 2009-270472 | A | 11/2009 |

* cited by examiner

*Primary Examiner* — Edward Look
*Assistant Examiner* — Liam McDowell
(74) *Attorney, Agent, or Firm* — Kenyon & Kenyon LLP

(57) ABSTRACT

A diffuser apparatus includes a diffuser communicating radially outwardly with an exit of an impellor. The apparatus includes a housing with a plate that is rotatable about a rotational axis and forms a hub side wall. A side surface of the plate has a vane having one circumferential end fixed to the plate; the other end is movable in the direction of the axis. The housing includes an inclination path with one end opened to the hub side wall to bendably guide the vane so that the other end of the vane moves in the circumferential direction upon rotation of the plate and moves in the direction of the axis to a projected position to project into the diffuser. An actuator rotates the plate to drive the vane between the projected position and a retracted position where the other end is retracted into the hub side wall.

5 Claims, 12 Drawing Sheets

DIFFUSER APPARATUS, CENTRIFUGAL COMPRESSOR, AND TURBO SUPERCHARGER

This is a 371 national phase application of PCT/JP2010/053900 filed 9 Mar. 2010, the content of which is incorporated herein by reference.

TECHNICAL FIELD

The present invention relates to a diffuser apparatus provided in a centrifugal compressor, the centrifugal compressor having the diffuser device, and a turbo supercharger having the centrifugal compressor.

BACKGROUND ART

There is a known centrifugal compressor in which a guide vane movable between a position where it is projected into a diffuser passage and a position where it is housed in a housing chamber provided in a diffuser wall is provided in a diffuser portion (see Patent Document 1). In addition, there is Patent Document 2 as prior art reference in relation to the present invention.

Citation List

Patent Literature

Patent Document 1: JP-A-2001-329996
Patent Document 2: JP-A-2008-095678

SUMMARY OF INVENTION

Technical Problem

In the centrifugal compressor of Patent Document 1, when the guide vane is housed in the housing chamber, a gap between the diffuser wall and the guide vane is produced. When foreign matters pass through the gap into the housing chamber and are accumulated between the guide vane and the diffuser wall, the guide vane is incapable of moving. In addition, in the centrifugal compressor, the housing chamber having substantially the same width as the height of the guide vane is required to be provided alongside of the diffuser portion. For this reason, the size of the centrifugal compressor is increased.

In view of the foregoing, an object of the present invention is to provide a diffuser apparatus, a centrifugal compressor, and a turbo supercharger, which can prevent the immovability of a vane due to foreign matters and are advantageous to downsizing.

Solution To Problem

A diffuser apparatus of the present invention is a diffuser apparatus which has a diffuser formed by a shroud side wall portion and a hub side wall portion opposite each other and provided as a passage space communicated with the exit side of an impellor radially outwardly of the impellor of a centrifugal compressor, the apparatus including a hollow disc-like rotational member, a housing member which houses the rotational member therein so as to be rotatable about a rotational axis of the impellor and forms either one wall portion of the shroud side wall portion or the hub side wall portion, and driving device for rotating the rotational member, in which the side surface of the rotational member on the diffuser side is provided with a plate-like vane member having one end in the circumferential direction fixed to the rotational member, the other end in the circumferential direction movable in the direction of the rotational axis, and flexibility, the housing member is provided with an inclination path which has one end opened to the portion which forms the one wall portion, and bendably guides the vane member so that the other end in the circumferential direction of the vane member is moved in the circumferential direction with the rotation of the rotational member and is moved in the direction of the rotational axis so as to be projected into the diffuser, and the driving device rotates the rotational member so that the vane member is driven between a projected position where the other end in the circumferential direction of the vane member is projected into the diffuser and a retracted position where the other end in the circumferential direction of the vane member is retracted into the one wall portion.

According to the diffuser apparatus of the present invention, the vane member is bent by the inclination path so as to be projected into the diffuser. For this reason, foreign matters are hard to be accumulated in the housing member or the portion between the inclination path and the vane member, and further, even when foreign matters are accumulated, they cannot inhibit the movement of the vane member. In addition, even when foreign matters are accumulated in the inclination path, they are removed by the vane member moved from the retracted position to the projected position. Therefore, the immovability of the vane due to the foreign matters is prevented. Further, in the diffuser apparatus of the present invention, when the vane member is housed in the housing member, it is extended in the circumferential direction by the inclination path. Consequently, as compared with when the vane member is moved only in the direction of the rotational axis and is housed, the space to be provided for housing the vane member can be smaller. Thus, it is possible to downsize the diffuser apparatus.

In one embodiment of the diffuser apparatus of the present invention, the shape of the vane member may be set so that the distance between the other end of the vane member and the one end of the inclination path in the retracted position is gradually increased from the inner circumference side toward the outer circumference side. In this case, the length in which the vane member is projected from the one wall portion when it is moved to the projected position can be the same on the outer circumference side and the inner circumference side. For this reason, the clearance between the other wall portion of the shroud side wall portion or the hub side wall portion and the other end of the vane member can be substantially the same on the outer circumference side and the inner circumference side. It is possible to increase an amount of gas which contacts on the vane member within gas passing through the diffuser.

In one embodiment of the diffuser apparatus of the present invention, the shape of the vane member may be set so that the length in which the vane member is projected from the one wall portion in the projected position is gradually increased from the inner circumference side toward the outer circumference side, and the inclination path may be provided in the housing member so that an inclination with respect to a plane orthogonal to the rotational axis is gradually decreased from the inner circumference side toward the outer circumference side. In this embodiment, a projection angle when the vane member is projected from the one wall portion into the diffuser can be gradually decreased from the inner circumference side toward the outer circumference side. For this reason, even when the vane member is more projective on the outer circumference side than on the inner circumference side, the other end of the vane member can be abutted onto the other wall portion of the shroud side wall portion or the hub side wall portion in the same manner on each of the inner circumference side and the outer circumference side. This enables the clearance between the other end of the vane member and the other wall portion to be substantially the same on the outer circumference side and the inner circumference side. Therefore, it is possible to increase an amount of gas which contacts on the vane member within gas passing through the diffuser.

A centrifugal compressor of the present invention has the diffuser apparatus mentioned above. In addition, a turbo supercharger of the present invention has the centrifugal compressor mentioned above, the centrifugal compressor being provided in the intake passage of an internal combustion engine. Each of the centrifugal compressor and the turbo supercharger of the present invention has the diffuser apparatus mentioned above. For this reason, as in the diffuser device, the immovability of the vane member due to foreign matters can be prevented. In addition, it is possible to downsize each of the centrifugal compressor and the turbo supercharger.

DESCRIPTION OF EMBODIMENTS (First Embodiment)

Figure 1:
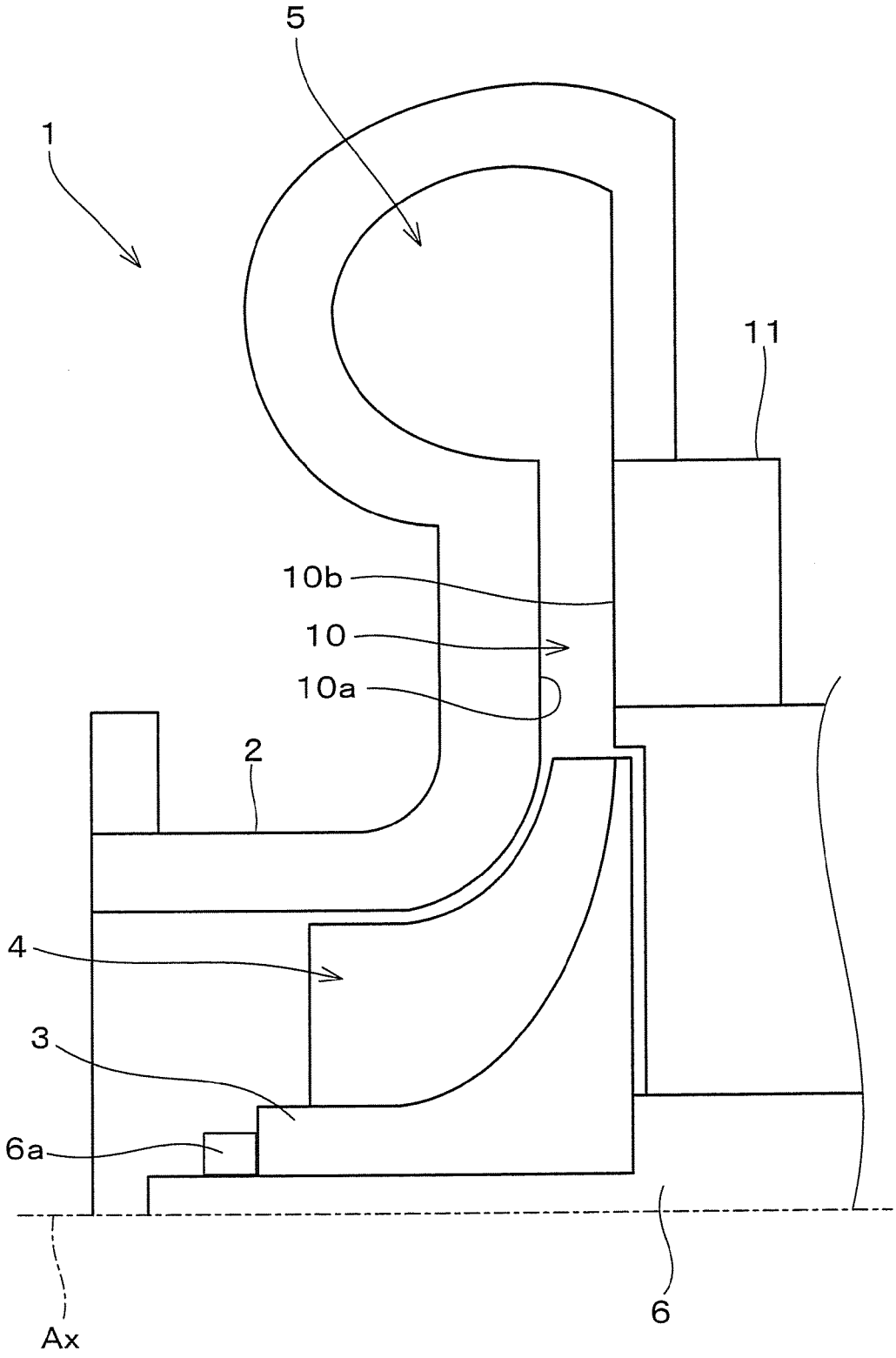
FIG. 1 is a view showing the cross section of a centrifugal compressor provided with a diffuser apparatus according to a first embodiment of the present invention.

FIG. 1 shows the cross section of a centrifugal compressor provided with a diffuser apparatus according to a first embodiment of the present invention. A centrifugal compressor 1 is incorporated into a turbo supercharger provided in an internal combustion engine in order to perform the supercharging of the internal combustion engine, and is provided in the intake passage of the internal combustion engine. As shown in this figure, the centrifugal compressor 1 includes a housing 2, and an impellor 3 housed in the housing 2. The housing 2 includes a wheel chamber 4 in which the impellor 3 is arranged, a diffuser 10 provided radially outwardly of the wheel chamber 4 and communicated with the exit of the wheel chamber 4, and a scrolled scroll chamber 5 provided on the outer circumference of the diffuser 10 and communicated with the diffuser 10. The impellor 3 is attached to a rotational shaft 6 rotatably provided about an axis Ax. In addition, the impellor 2 is fixed to the rotational shaft 6 by a nut 6*a*. Further, the turbine wheel of a turbine provided in the exhaust passage of the internal combustion engine is attached to the other end of the rotational shaft 6.

Figure 2:
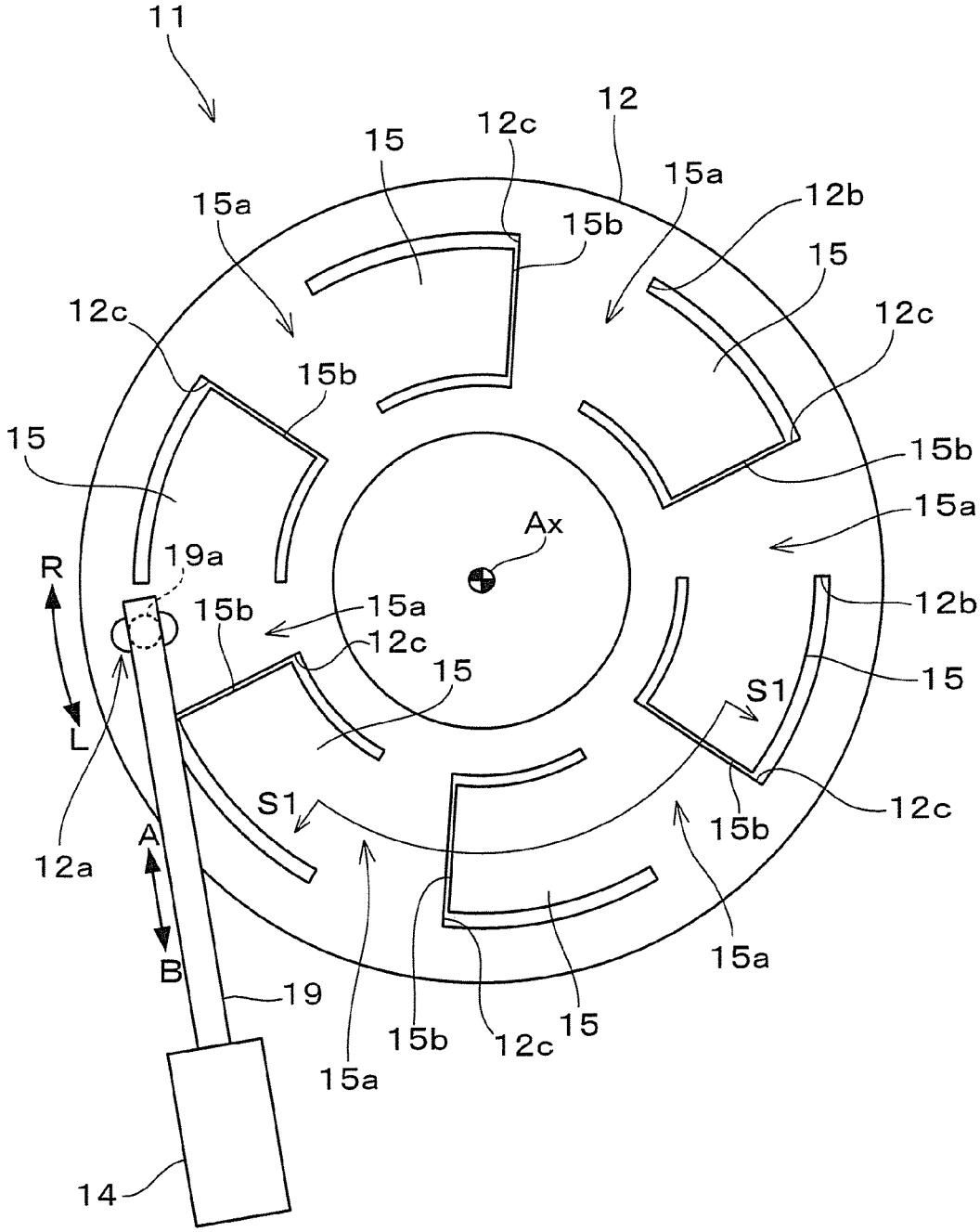
FIG. 2 is a view of a main part of a movable vane mechanism viewed from the direction of an axis.
Figure 3:
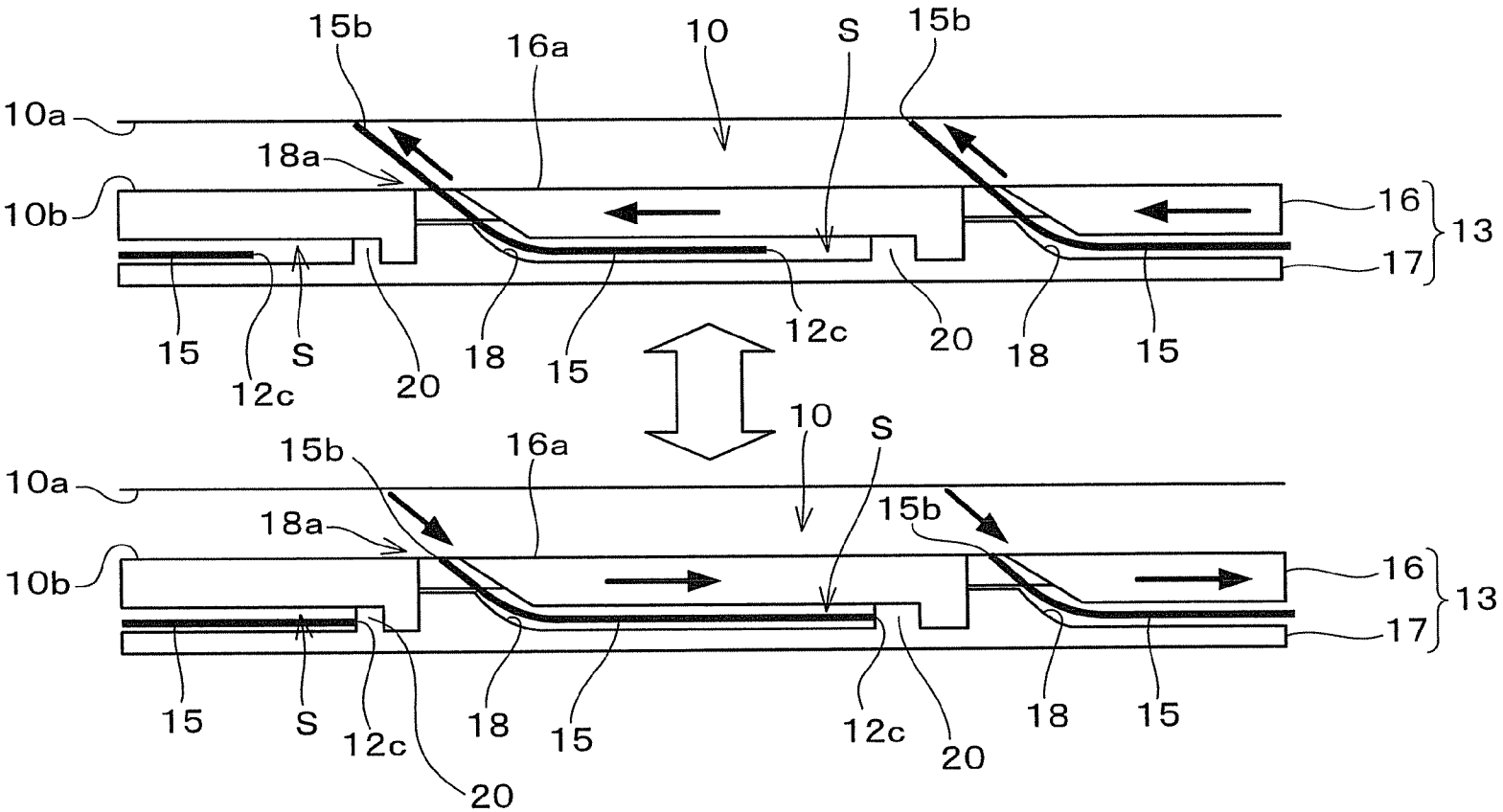
FIG. 3 is a view showing the cross sections of a diffuser taken along line S1-S1 of FIG. 2.

The diffuser apparatus will be described in detail with reference to FIGS. 1 to 3. As shown in FIG. 1, the diffuser 10 is formed by a shroud side wall portion 10*a* and a hub side wall portion 10*b* opposite each other. A movable vane mechanism 11 is provided in the hub side wall portion 10*b*. FIG. 2 is a view of the main part of the movable vane mechanism 11 viewed from the direction of the axis Ax. In addition, FIG. 3 shows the cross sections of the diffuser 10 taken along line S1-S1 of FIG. 2. As shown in these figures, the movable vane mechanism 11 includes a rotational plate 12 as a rotational member, a housing portion 13 as a housing member which houses the rotational plate 12 therein, and an actuator 14 as a driving device which rotates the rotational plate 12.

The rotational plate 12 is hollow disc-like, and is housed in the housing portion 13 so as to be rotatable about the axis Ax. Plural (six in FIG. 2) vanes 15 are provided in the rotational plate 12. As shown in FIG. 2, the vanes 15 are arranged at intervals on the same circumference. Each of the vanes 15 is a thin plate member having flexibility. In the vane 15, only one end 15*a* in the circumferential direction is connected to the rotational plate 12, and the portion other than that is separated from the rotational plate 12.

As shown in FIG. 3, the housing portion 13 includes a first plate 16, and a second plate 17. As shown in this figure, the first plate 16 is arranged on the diffuser 10 side so as to form the hub side wall portion 10*b*. The first plate 16 and the second plate 17 are combined so that the rotational plate 12 is interposed therebetween. In this case, a space S is formed between the first plate 16 and the second plate 17, and the rotational plate 12 is arranged in the space S. A hole (not shown) having substantially the same size as the outside diameter of the rotational plate 12 is provided in the portion of the second plate 17 forming the space S. In addition, a shaft (not shown) having substantially the same size as the inside diameter of the rotational plate 12 is provided in the center of the hole so as to be coaxial with the hole. The rotational plate 12 is arranged in the space S so as to be inserted into the shaft. Therefore, the rotational plate 12 is incapable of moving to the radial direction.

As shown in this figure, inclination paths 18 which communicate the space S and the diffuser 10 are provided in the housing portion 13. The inclination paths 18 are provided so as to be equal in number to that of the vanes 15. In addition, the inclination paths 18 are provided at intervals in the circumferential direction. The cross section shape of each of the inclination paths 18 is set to a size in which the vane 15 is slidably movable when the rotational plate 12 is rotated. One end 18*a* of the inclination path 18 is opened to a surface 16*a* of the first plate 16 on which the diffuser 10 is formed. As shown in this figure, the other end 15*b* of the vane 15 is arranged in the inclination path 18. The inclination path 18 bends the vane 15 so that the other end 15*b* of the vane 15 is moved in the direction of the axis Ax while being moved in the circumferential direction when the rotational plate 12 is rotated.

The actuator 14 is connected to the rotational plate 12 via a driving rod 19. A driving hole 12*a* is provided in the rotational plate 12, and a driving pin 19*a* provided at the end of the driving rod 19 is inserted into the driving hole 12*a*.

In the movable vane mechanism 11, when the driving rod 19 is driven by the actuator 14 in the direction of an arrow A of FIG. 2, the rotational plate 12 is rotated in the direction of an arrow R. Then, this also makes the vane 15 to be rotated in the direction of the arrow R. In this case, as shown in the upper diagram of FIG. 3, the vane 15 is rotated while being bent by the inclination path 18 so that the other end 15*b* is projected from the first plate 16 into the diffuser 10. The actuator 14 stops the rotational plate 12 when the other end 15*b* of the vane 15 reaches the shroud side wall portion 10*a*. In addition, in the second plate 17, each of first projections (not shown) onto which each of first positioning portions 12*b* of the rotational plate 12 is abutted when the rotational plate 12 is rotated to this position is projected into the space S. Further, the position of the vane 15 in this case corresponds to a projected position of the present invention.

On the other hand, when the driving rod 19 is driven by the actuator 14 in the direction of an arrow B of FIG. 2, the rotational plate 12 is rotated in the direction of an arrow L. This makes the vane 15 to be moved in the direction of the arrow L, so that as shown in the lower diagram of FIG. 3, the vane 15 is retracted into the first plate 16. The actuator 14 stops the rotational plate 12 when the entire vane 15 is retracted into the first plate 16. In the second plate 17, each of second projections 20 onto which each of second positioning portions 12*c* of the rotational plate 12 is abutted when the rotational plate 12 is rotated to this position is projected into the space S. Further, the position of the vane 15 in this case corresponds to a retracted position of the present invention.

As described above, according to the diffuser apparatus of the first embodiment, the vane 15 is moved in the circumferential direction, and is bent by the inclination path 18 so as to be projected into the diffuser 10. For this reason, foreign matters are hard to be accumulated in the space S or between the inclination path 18 and the vane 15, and further, even when foreign matters are accumulated, they cannot inhibit the movement of the vane 15. In addition, for instance, even when foreign matters are accumulated in the inclination path 18, they are removed by the vane 15 when the vane 15 is moved from the retracted position to the projected position. Therefore, the immovability of the vane 15 due to the foreign matters is prevented. Further, as shown in FIG. 3, in the diffuser 10 of the first embodiment, the vane 15 is housed in the space S while being bent in the circumferential direction by the inclination path 18. Consequently, as compared with when the vane 15 is moved only in the direction of the axis Ax and is housed, the space for housing the vane 15 can be smaller. Thus, it is possible to downsize the diffuser 10.

Figure 4:
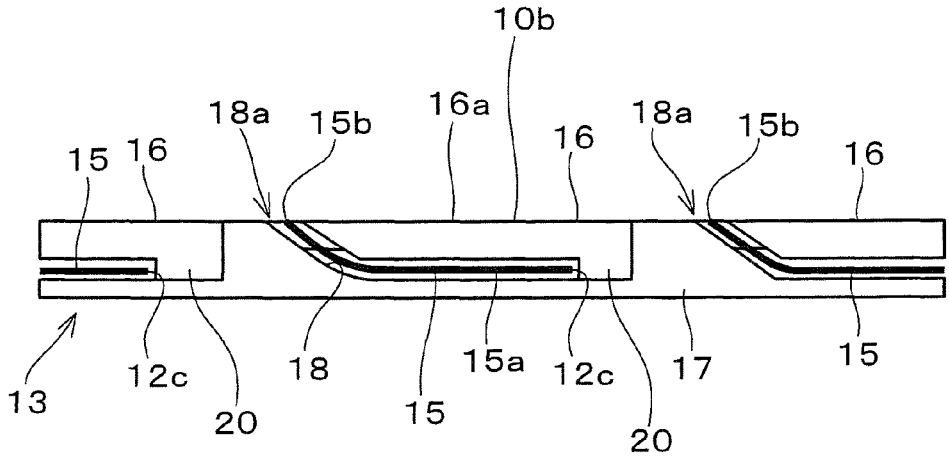
FIG. 4 is a view showing a variation of the diffuser apparatus according to the first embodiment.

The shape of the inclination path 18 is not limited to the shape shown in FIG. 3. For instance, as shown in FIG. 4, the portion of the second plate 17, which forms the inclination path 18 may be provided until it reaches the diffuser 10. In this case, the cross section shape of the inclination path 18 is the same to the one end 18*a*. For this reason, the projection and retraction of the vane 15 can be smoothly performed. Further, in the example shown in this figure, the second projection 20 is provided to the first plate 16. In this way, the second projection 20 may be provided to either of the first plate 16 and the second plate 17.

(Second Embodiment)

Figure 5:
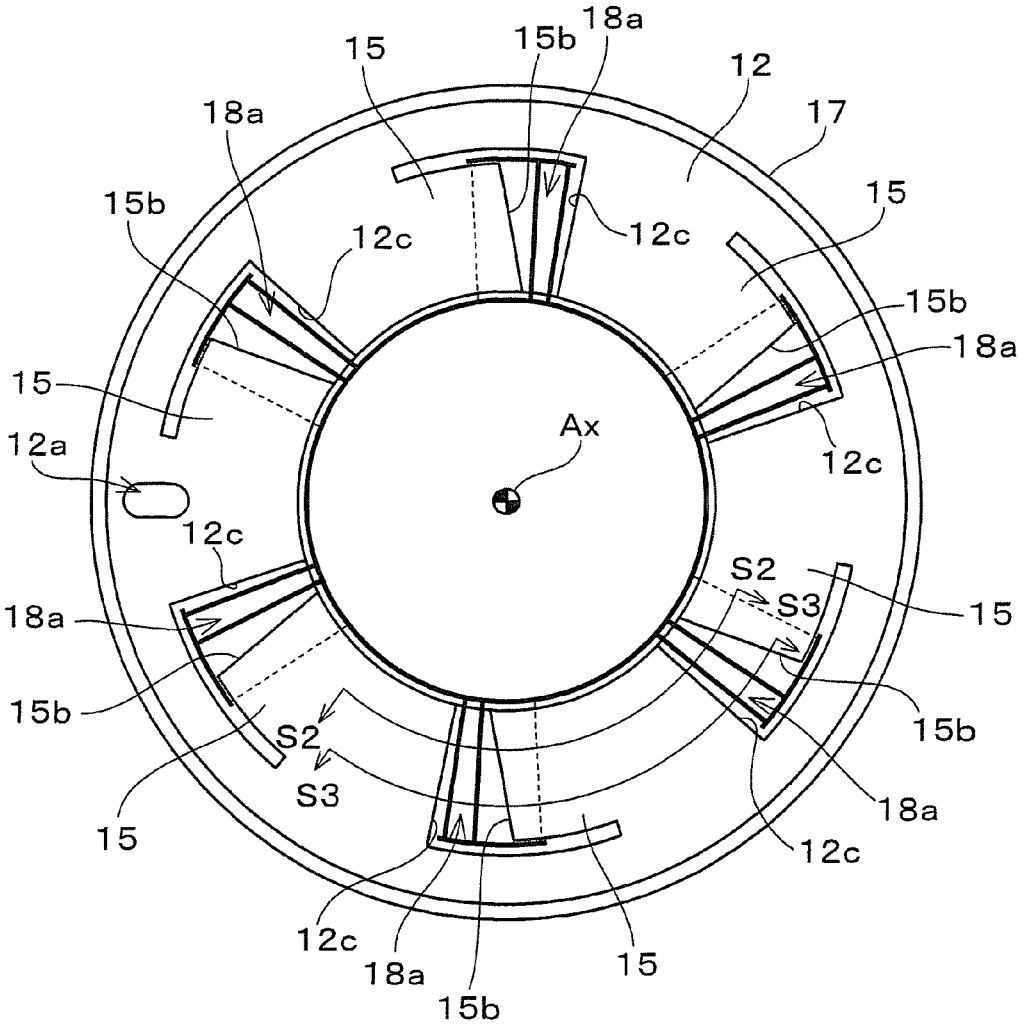
FIG. 5 is a view showing the movable vane mechanism of the diffuser apparatus according to a second embodiment of the present invention viewed from the direction of the axis.
Figure 6:
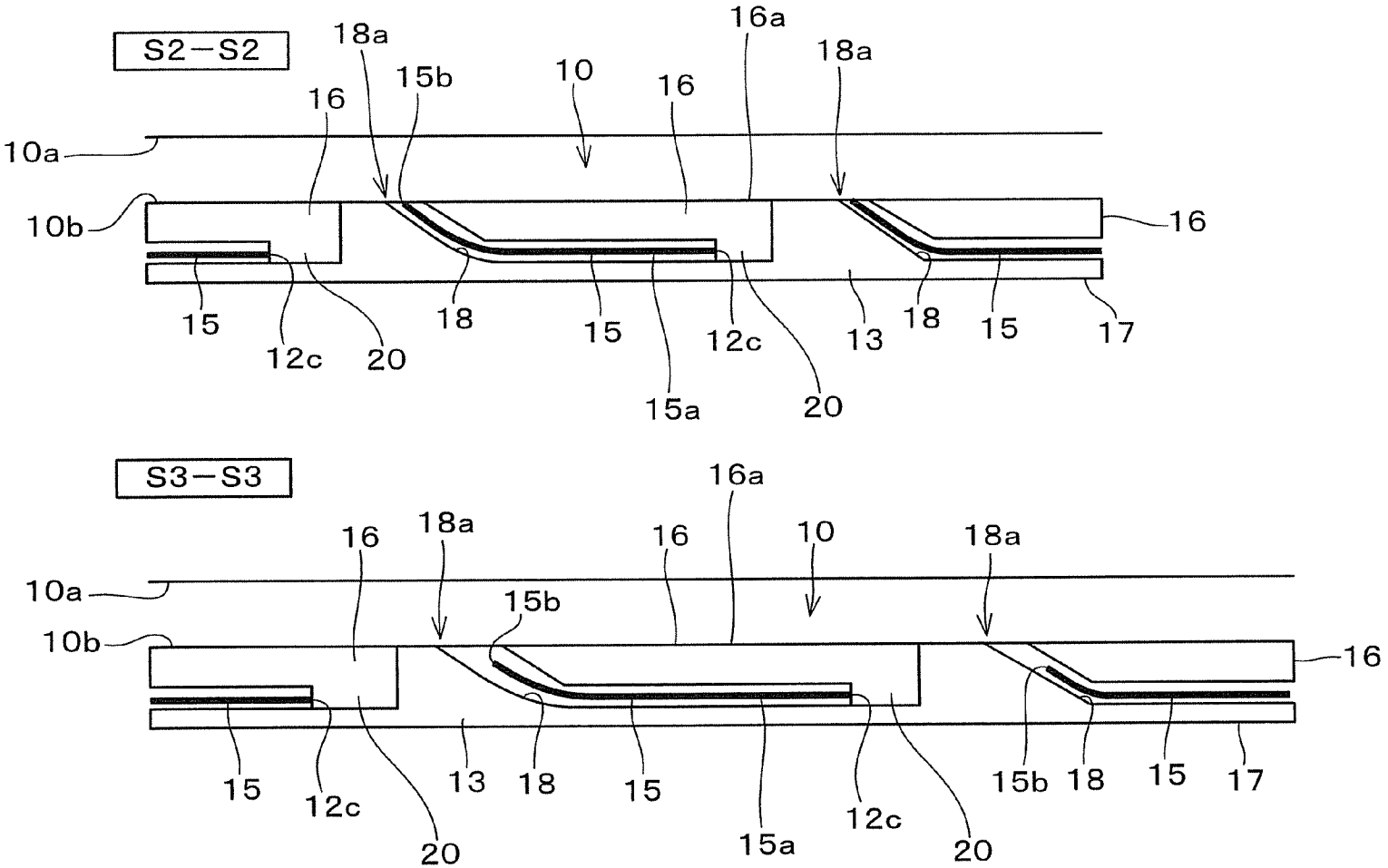
FIG. 6 is a view showing the cross sections of the movable vane mechanism taken along line S2-S2 and line S3-S3 of FIG. 5 when a vane is in a retracted position.
Figure 7:
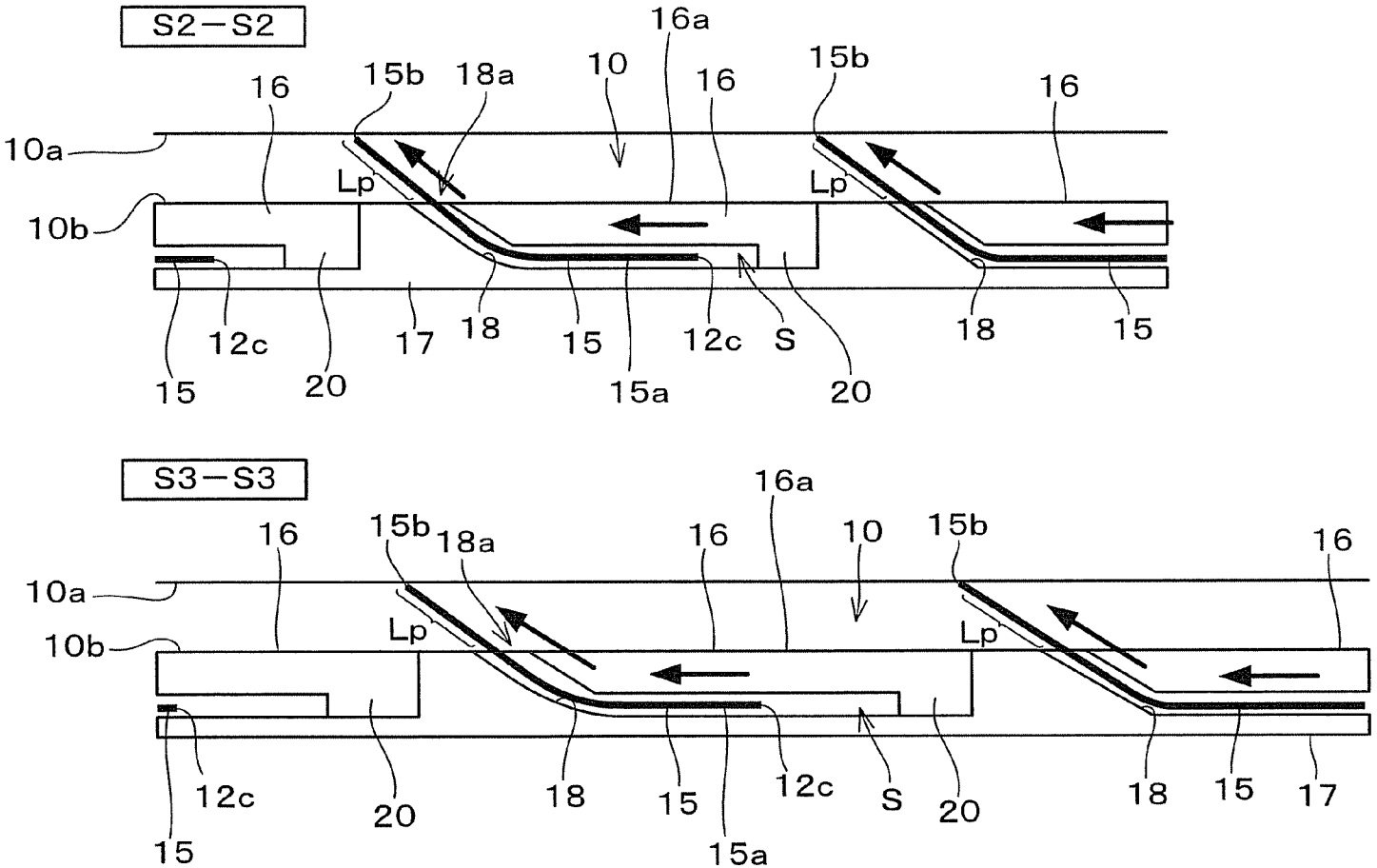
FIG. 7 is a view showing the cross sections of the movable vane mechanism taken along line S2-S2 and line S3-S3 of FIG. 5 when the vane is in a projected position.

Next, the diffuser apparatus according to a second embodiment will be described with reference to FIGS. 5 to 7. Further, in this embodiment, components in common with the first embodiment are denoted by the same reference numerals and the description will be omitted. FIG. 5 is a view showing the movable vane mechanism 11 of this embodiment viewed from the direction of the axis Ax. FIG. 6 shows the cross sections of the movable vane mechanism 11 taken along line S2-S2 and line S3-S3 of FIG. 5 when the vane 15 is in the retracted position. FIG. 7 shows the cross sections of the movable vane mechanism 11 taken along line S2-S2 and line S3-S3 of FIG. 5 when the vane 15 is in the projected position. Further, in FIGS. 6 and 7, each of the upper diagrams shows the cross section taken along line S2-S2, and each of the lower diagrams shows the cross section taken along line S3-S3.

As shown in FIG. 6, in this embodiment, the shape of the vane 15 is set so that the distance between the other end 15*b* of the vane 15 in the retracted position and the one end 18*a* of the inclination path 18 is gradually increased from the inner circumference side toward the outer circumference side. For this reason, as shown in this figure, in the vane 15 in the retracted position, on the inner circumference side, the other end 15*b* is flush with the hub side wall portion 10*b*, but on the outer circumference side, the other end 15*b* is drawn into the hub side wall portion 10*b*. In addition, as shown in FIG. 5, in this embodiment, the respective vanes 15 are provided on the inner circumference of the rotational plate 12.

According to this embodiment, the shape of the vane 15 is set so that the distance between the other end 15*b* of the vane 15 in the retracted position and the one end 18*a* of the inclination path 18 is gradually increased from the inner circumference side toward the outer circumference side. For this reason, as shown in FIG. 7, a length Lp in which the vane 15 is projected from the hub side wall portion 10*b* when it is moved to the projected position can be the same on the outer circumference side and the inner circumference side. This enables the clearance between the other end 15*b* of the vane 15 and the shroud side wall portion 10*a* to be substantially the same on the outer circumference side and the inner circumference side. For this reason, it is possible to increase an amount of gas which contacts on the vane 15 within gas passing through the diffuser 10.

(Third Embodiment)

Figure 8:
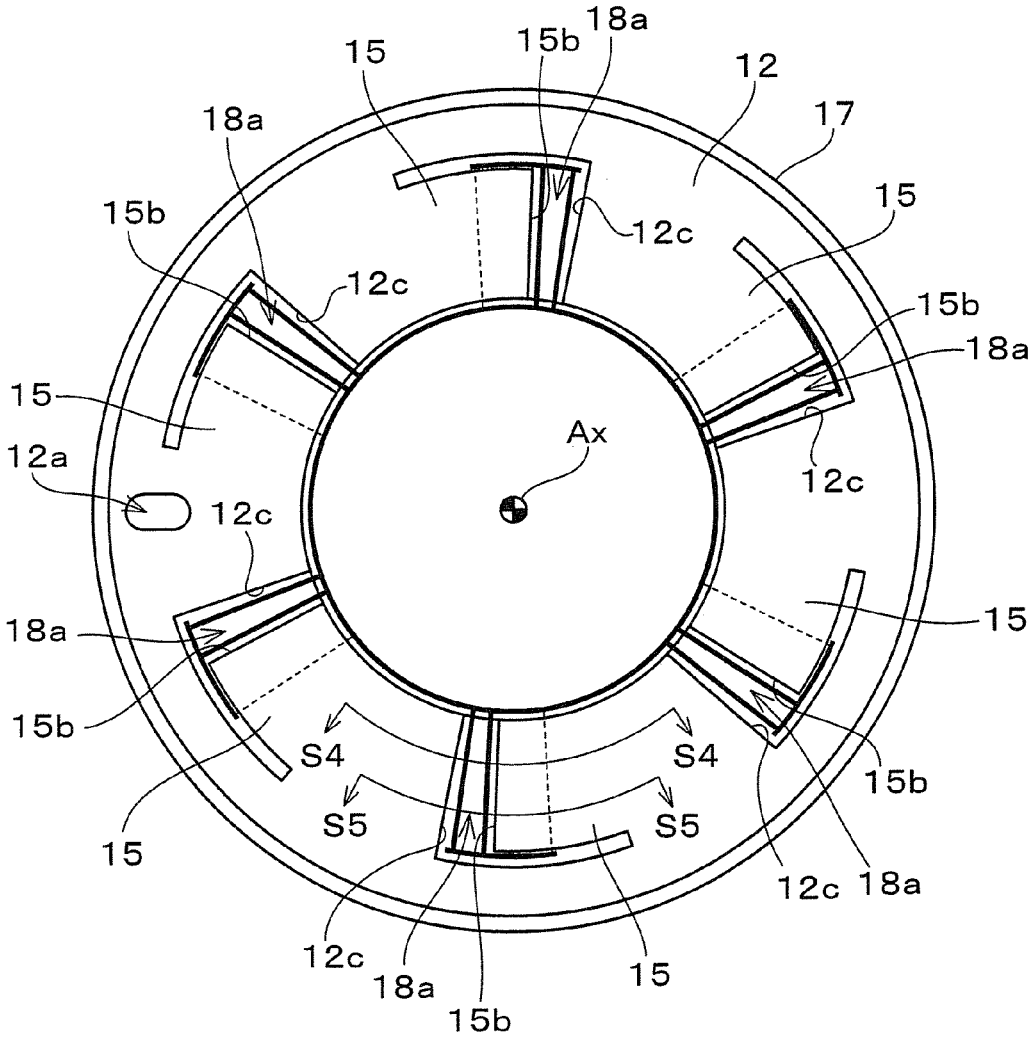
FIG. 8 is a view showing the movable vane mechanism of the diffuser apparatus according to a third embodiment of the present invention viewed from the direction of the axis.
Figure 9:
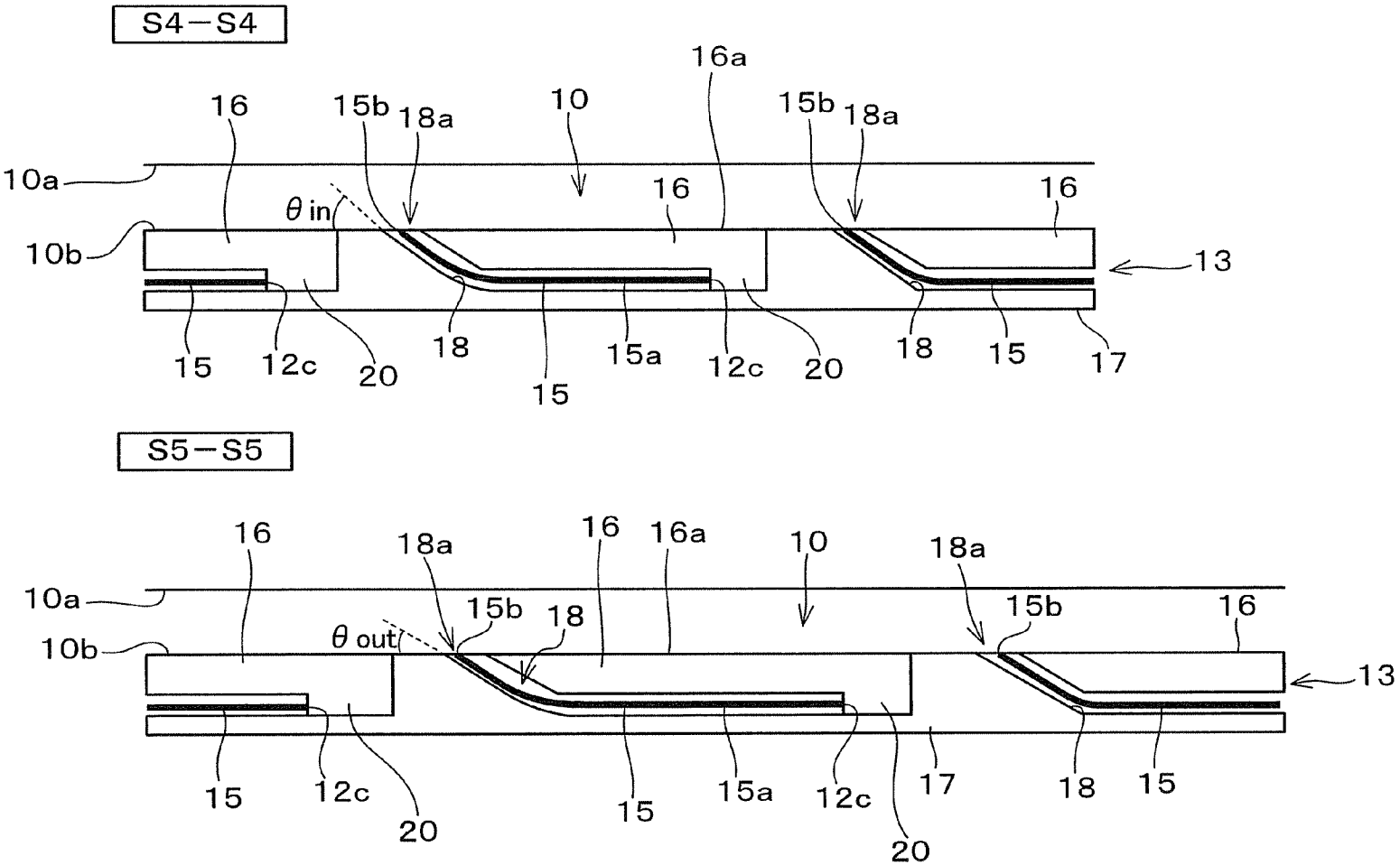
FIG. 9 is a view showing the cross sections of the movable vane mechanism taken along line S4-S4 and line S5-S5 of FIG. 8 when the vane is in the retracted position.
Figure 10:
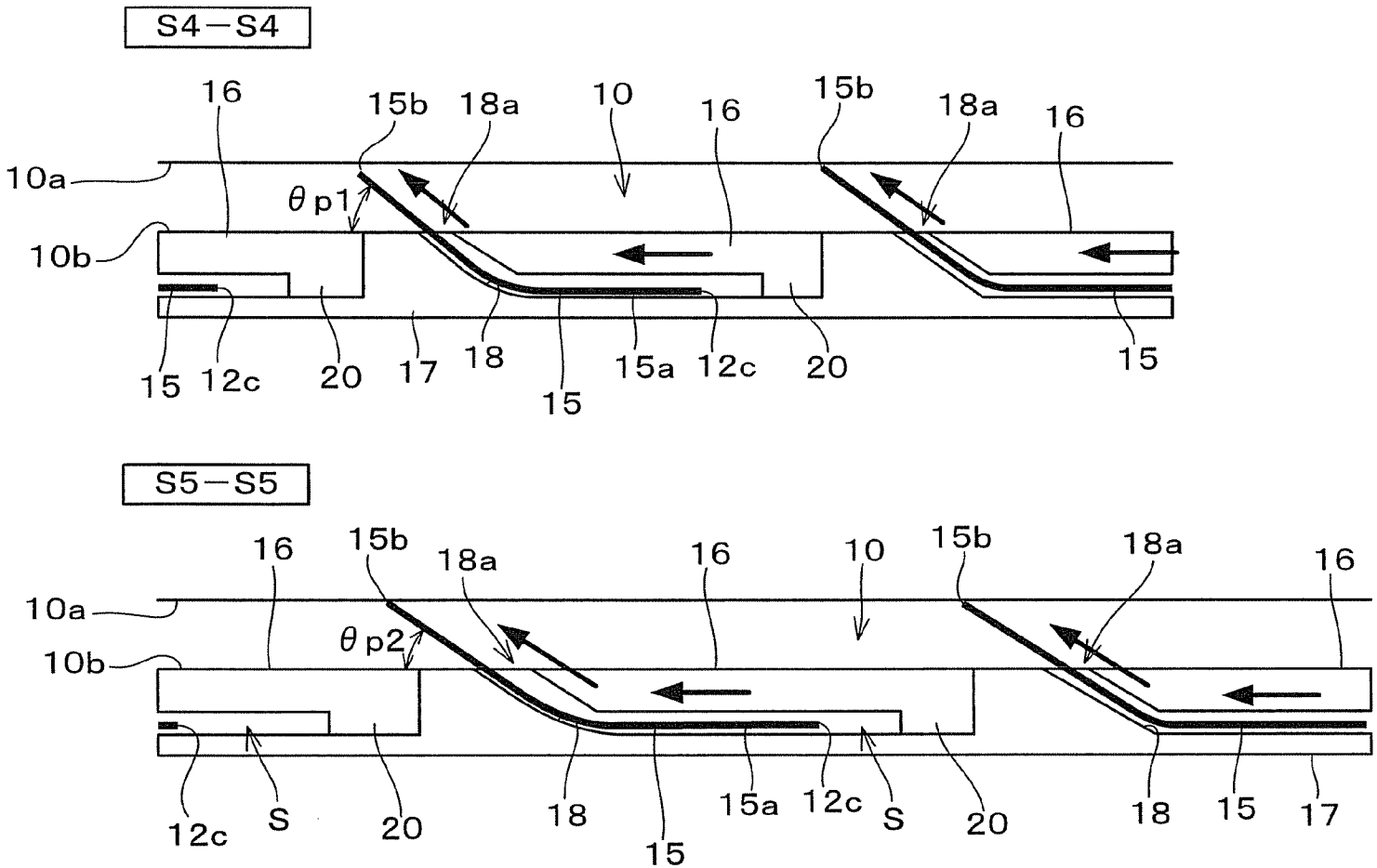
FIG. 10 is a view showing the cross sections of the movable vane mechanism taken along line S4-S4 and line S5-S5 of FIG. 8 when the vane is in the projected position.

The diffuser apparatus according to a third embodiment will be described with reference to FIGS. 8 to 10. Further, in this embodiment, components in common with the above embodiments are denoted by the same reference numerals and the description will be omitted. FIG. 8 is a view showing the movable vane mechanism 11 of this embodiment viewed from the direction of the axis Ax. FIG. 9 shows the cross sections of the movable vane mechanism 11 taken along line S4-S4 and line S5-S5 of FIG. 8 when the vane 15 is in the retracted position. FIG. 10 shows the cross sections of the movable vane mechanism 11 taken along line S4-S4 and line S5-S5 of FIG. 8 when the vane 15 is in the projected position. Further, in FIGS. 9 and 10, each of the upper diagrams shows the cross section taken along line S4-S4, and each of the lower diagrams shows the cross section taken along line S5-S5.

In this embodiment, an inclination θ of the inclination path 18 with respect to a plane orthogonal to the axis Ax (in FIG. 9, the wall surface of the hub side wall portion 10*b*) is gradually decreased from the inner circumference side toward the outer circumference side. For this reason, as shown in FIG. 9, an inclination θout of the inclination path 18 on the outer circumference side is smaller than an inclination θin of the inclination path 18 on the inner circumference side. In this case, as shown in FIG. 10, when the vane 15 is moved to the projected position, a projection angle θp2 on the outer circumference side of the vane 15 is smaller than a projection angle θp1 on the inner circumference side.

According to this embodiment, the inclination θ of the inclination path 18 with respect to the plane orthogonal to the axis Ax is gradually decreased from the inner circumference side toward the outer circumference side, so that a projection angle θp of the vane 15 is gradually decreased from the inner circumference side toward the outer circumference side. As shown in FIG. 8, the length in the circumferential direction of the vane 15 on the outer circumference side is longer than that on the inner circumference side, so that the length in which the vane 15 is projected from the hub side wall portion 10*b* on the outer circumference side is longer than that on the inner circumference side. In this embodiment, the projection angle θp is gradually decreased from the inner circumference side toward the outer circumference side, so that even when the vane 15 is more projective on the outer circumference side than on the inner circumference side, the other end 15*b* of the vane 15 can be abutted onto the shroud side wall portion 10*a* in the same manner on each of the inner circumference side and the outer circumference side. For this reason, the clearance between the other end 15*b* of the vane 15 and the shroud side wall portion 10*a* are substantially the same on the outer circumference side and the inner circumference side. Therefore, it is possible to increase an amount of gas which contacts on the vane 15 within gas passing through the diffuser 10.

The present invention is not limited to the above embodiments, and may be embodied in various forms. For instance, in the above embodiments, the centrifugal compressor of the present invention is incorporated into the turbo supercharger, but the centrifugal compressor of the present invention may be used alone without being incorporated into the turbo supercharger. The diffuser apparatus of the present invention may be provided to the shroud side wall portion.

Figure 11:
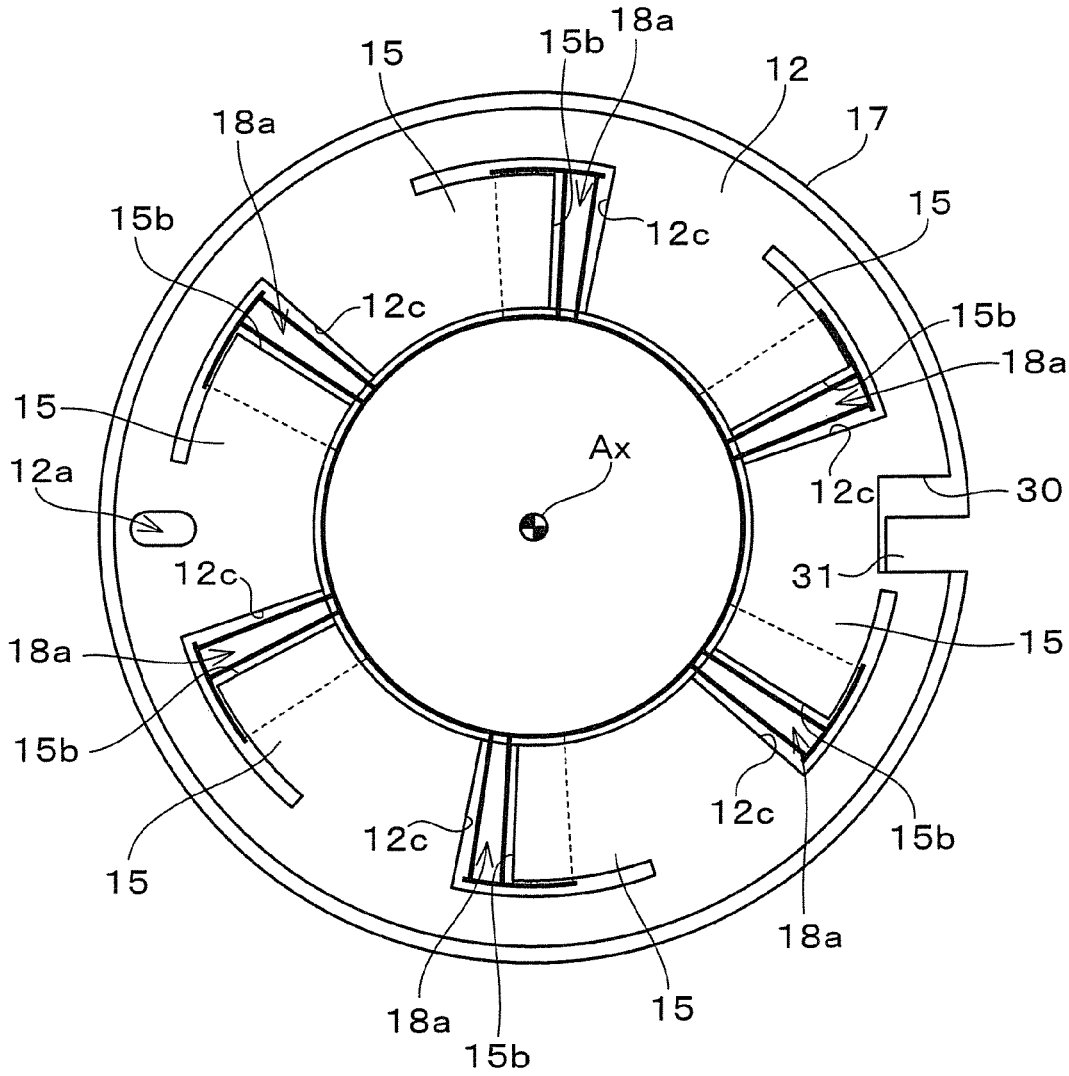
FIG. 11 is a view showing a main part of a first variation of the diffuser apparatus of the present invention.
Figure 12:
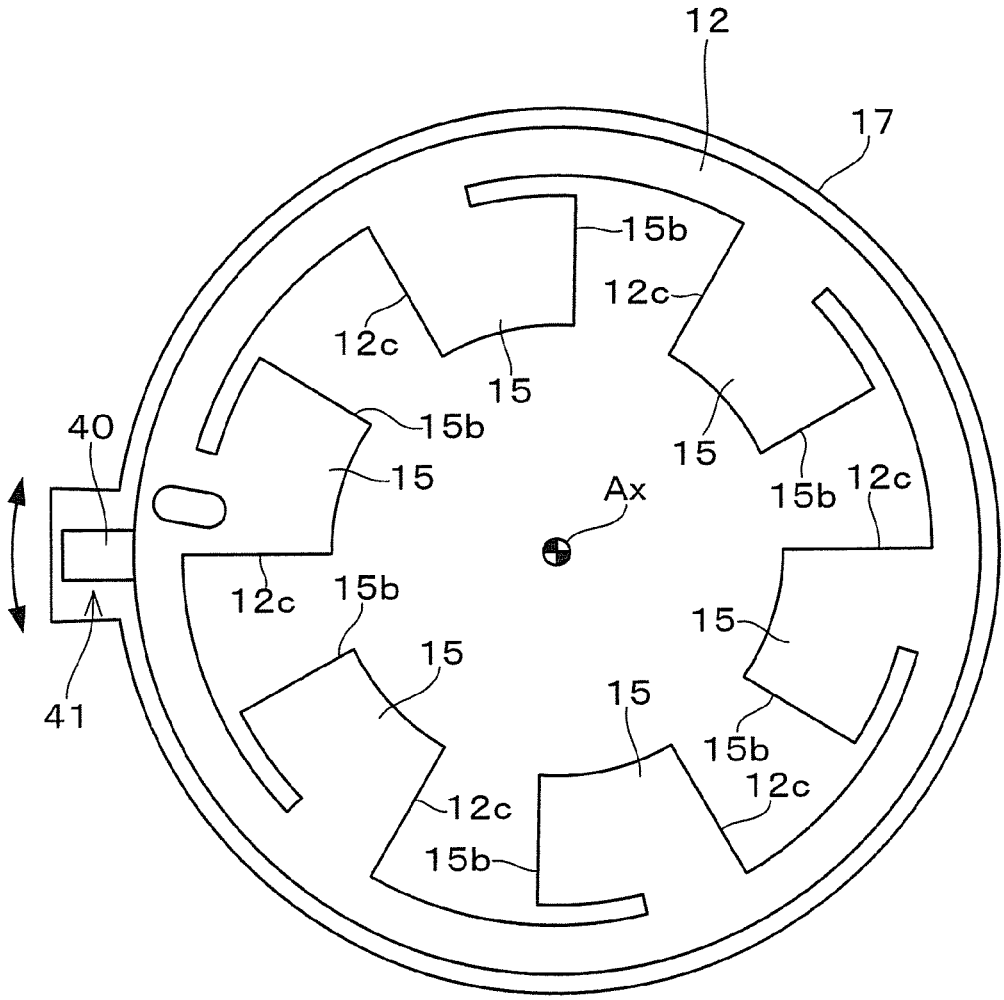
FIG. 12 is a view showing a main part of a second variation of the diffuser apparatus of the present invention.

The mechanism for stopping the rotation of the rotational plate in the projected position or the retracted position is not limited to the mechanism of the above form. For instance, as shown in FIG. 11, a concave portion 30 which is concave radially inwardly is provided to the outer circumference of the rotational plate 12. In addition, a convex portion 31 which is projected into the concave portion 30 is provided to the second plate 17. Then, the width in the circumferential direction of at least either of the concave portion 30 and the convex portion 31 is appropriately set, so that the positioning in the rotation direction of the rotational plate 12 may be performed. In addition, as shown in FIG. 12, a convex portion 40 which is projected radially outwardly may be provided on the outer circumference of the rotational plate 12, and a concave portion 41 in which the convex portion 40 is arranged may be provided to the second plate 17. Also, in this case, the width in the circumferential direction of at least either of the convex portion 40 and the concave portion 41 is appropriately set, so that the positioning in the rotation direction of the rotational plate 12 may be performed.

Figure 13:
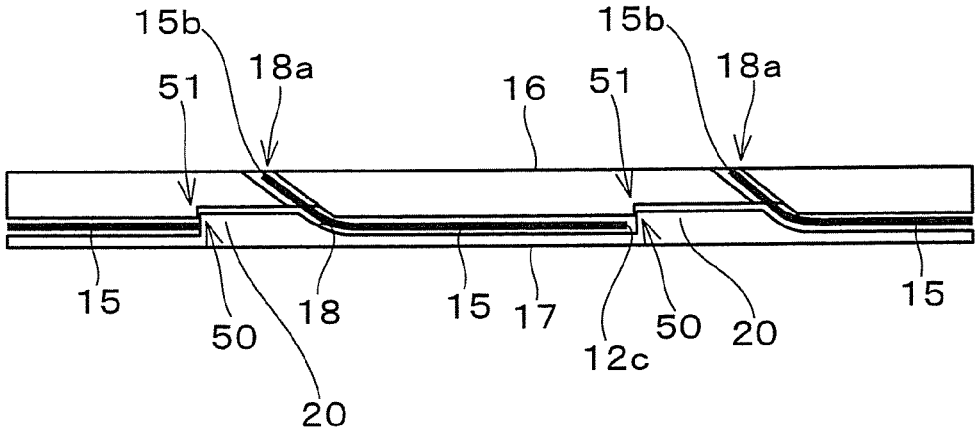
FIG. 13 is a view showing a main part of a third variation of the diffuser apparatus of the present invention.
Figure 14:
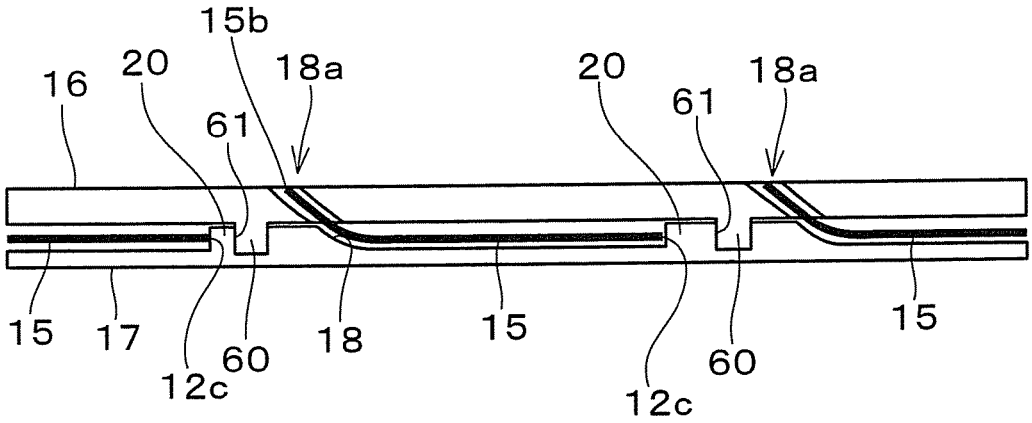
FIG. 14 is a view showing a main part of a fourth variation of the diffuser apparatus of the present invention.

The shape of each of the first plate 16 and the second plate 17 is not limited to the shape of the above embodiments. For instance, the first plate 16 and the second plate 17 may have the same thickness. In this case, as shown in FIG. 13, a step 50 is provided to the portion of the first plate 16 combined with the second plate 17. Likewise, a step 51 which engages the step 50 of the first plate 16 is provided to the second plate 17. Then, the second plate 17 may be positioned with respect to the first plate 16 by engaging the steps 50 and 51. In addition, as shown in FIG. 14, a convex portion 60 is provided to the portion of the first plate 16 opposite the second plate 17, and a concave portion 61 into which the convex portion 60 is fitted is provided to the second plate 17. Then, the second plate 17 may be positioned with respect to the first plate 16 by fitting the convex portion 60 into the concave portion 61.

The invention claimed is:

1. A diffuser apparatus which has a diffuser formed by a shroud side wall portion and a hub side wall portion opposite each other and provided as a passage space communicated with an exit side of an impellor radially outwardly of the impellor of a centrifugal compressor, the apparatus comprising:

a hollow disc-like rotational member, a housing member which houses the rotational member therein so as to be rotatable about a rotational axis of the impellor and forms either one wall portion of the shroud side wall portion and the hub side wall portion, and a driving device for rotating the rotational member, wherein a side surface of the rotational member on a diffuser side is provided with a plate-like vane member having one end in a circumferential direction fixed to the rotational member, an other end in the circumferential direction movable in a direction of the rotational axis, and being flexible, the housing member is provided with an inclination path which has one end opened to a portion which forms the one wall portion, and bendably guides the vane member so that the other end in the circumferential direction of the vane member is moved in the circumferential direction with the rotation of the rotational member and is moved in the direction of the rotational axis so as to be projected into the diffuser, and the driving device rotates the rotational member so that the vane member is driven between a projected position where the other end in the circumferential direction of the vane member is projected into the diffuser and a retracted position where the other end in the circumferential direction of the vane member is retracted into the one wall portion.

2. The diffuser apparatus according to claim 1, wherein the shape of the vane member is set so that the distance between the other end of the vane member and the one end of the inclination path in the retracted position is gradually increased from the inner circumference side toward the outer circumference side.

3. The diffuser apparatus according to claim 1, wherein the shape of the vane member is set so that the length in which the vane member is projected from the one wall portion in the projected position is gradually increased from the inner circumference side toward the outer circumference side, and the inclination path is provided in the housing member so that an inclination with respect to a plane orthogonal to the rotational axis is gradually decreased from the inner circumference side toward the outer circumference side.

4. A centrifugal compressor comprising a diffuser apparatus which has a diffuser formed by a shroud side wall portion and a hub side wall portion opposite each other and provided as a passage space communicated with an exit side of an impellor radially outwardly of the impellor of a centrifugal compressor, the apparatus comprising:

a hollow disc-like rotational member, a housing member which houses the rotational member therein so as to be rotatable about a rotational axis of the impellor and forms either one wall portion of the shroud side wall portion and the hub side wall portion, and a driving device for rotating the rotational member, wherein a side surface of the rotational member on a diffuser side is provided with a plate-like vane member having one end in a circumferential direction fixed to the rotational member, an other end in the circumferential direction movable in a direction of the rotational axis and being flexible, the housing member is provided with an inclination path which has one end opened to a portion which forms the one wall portion, and bendably guides the vane member so that the other end in the circumferential direction of the vane member is moved in the circumferential direction with the rotation of the rotational member and is moved in the direction of the rotational axis so as to be projected into the diffuser, and the driving device rotates the rotational member so that the vane member is driven between a projected position where the other end in the circumferential direction of the vane member is projected into the diffuser and a retracted position where the other end in the circumferential direction of the vane member is retracted into the one wall portion.

5. A turbo super charger comprising a centrifugal compressor provided in the intake passage of an internal combustion engine, the centrifugal compressor comprising a diffuser apparatus which has a diffuser formed by a shroud side wall portion and a hub side wall portion opposite each other and provided as a passage space communicated with an exit side of an impellor radially outwardly of the impellor of a centrifugal compressor, the apparatus comprising:

a hollow disc-like rotational member, a housing member which houses the rotational member therein so as to be rotatable about a rotational axis of the impellor and forms either one wall portion of the shroud side wall portion and the hub side wall portion, and a driving device for rotating the rotational member, wherein a side surface of the rotational member on a diffuser side is provided with a plate-like vane member having one end in a circumferential direction fixed to the rotational member, an other end in the circumferential direction movable in a direction of the rotational axis and being flexible, the housing member is provided with an inclination path which has one end opened to a portion which forms the one wall portion, and bendably guides the vane member so that the other end in the circumferential direction of the vane member is moved in the circumferential direction with the rotation of the rotational member and is moved in the direction of the rotational axis so as to be projected into the diffuser, and the driving device rotates the rotational member so that the vane member is driven between a projected position where the other end in the circumferential direction of the vane member is projected into the diffuser and a retracted position where the other end in the circumferential direction of the vane member is retracted into the one wall portion.

* * * * *